US009593620B2

(12) United States Patent
Makino et al.

(10) Patent No.: US 9,593,620 B2
(45) Date of Patent: Mar. 14, 2017

(54) MUFFLER HANGER

(71) Applicants: SUMITOMO RIKO COMPANY LIMITED, Komaki-shi, Aichi (JP); HONDA MOTOR CO., LTD., Tokyo (JP)

(72) Inventors: Takashi Makino, Kasugai (JP); Fumihiro Ohsawa, Wako (JP)

(73) Assignees: SUMITOMO RIKO COMPANY LIMITED, Komaki-shi, Aichi (JP); HONDA MOTOR CO., LTD., Tokyo (JP)

( * ) Notice: Subject to any disclaimer, the term of this patent is extended or adjusted under 35 U.S.C. 154(b) by 160 days.

(21) Appl. No.: 14/634,005

(22) Filed: Feb. 27, 2015

(65) Prior Publication Data

US 2015/0260076 A1 Sep. 17, 2015

(30) Foreign Application Priority Data

Mar. 11, 2014 (JP) ..... 2014-047170
Jan. 15, 2015 (JP) ..... 2015-006148

(51) Int. Cl.
*F16M 13/00* (2006.01)
*F01N 13/18* (2010.01)

(52) U.S. Cl.
CPC ..... *F01N 13/1822* (2013.01)

(58) Field of Classification Search
CPC ..... F16F 7/00; F16F 7/10; F16F 7/104; B60K 13/04; B60K 17/24
USPC ..... 248/548, 561, 563, 568, 570, 580, 581, 248/608, 609, 610, 611, 612, 618, 632, 248/634, 635, 636, 644, 613; 267/136, 267/140.11, 140.3, 140.4, 140.5, 141, 267/141.1; 180/309, 381
See application file for complete search history.

(56) References Cited

U.S. PATENT DOCUMENTS 4,976,412 A * 12/1990 Simon ..... F16F 3/12 248/632
5,050,837 A 9/1991 Hamada et al.
(Continued)

FOREIGN PATENT DOCUMENTS

DE 10023781 B4 2/2012
FR 2684152 A1 * 5/1993 ..... B29C 47/0028
JP 2010-242606 A 10/2010

*Primary Examiner* — Terrell McKinnon
*Assistant Examiner* — Michael McDuffie
(74) *Attorney, Agent, or Firm* — Oliff PLC

(57) ABSTRACT

A muffler hanger including: a displacement suppress member integrally provided with upper and lower support parts and a junction part that joins the support parts to each other at their lengthwise middle parts; and mounting rubbers that connect the support parts to each other at lengthwise both sides and each includes a pair of arch shaped parts having a mounting hole. The displacement suppress member is configured to attach to one of a vehicle body and a muffler. By inserting mounting parts provided to the other of the vehicle body and the muffler into the corresponding mounting hole, the mounting rubbers are configured to attach thereto. A displacement regulator that limits a relative displacement volume of the muffler in relation to the vehicle body is constituted by abutment of the mounting parts against the displacement suppress member.

10 Claims, 16 Drawing Sheets

(56) References Cited

U.S. PATENT DOCUMENTS 5,065,555 A * 11/1991 Kobori ..... E04B 1/98
248/548
5,280,890 A * 1/1994 Wydra ..... F16F 1/373
267/136
5,398,907 A * 3/1995 Kelchner ..... F16L 55/035
248/60
5,490,356 A * 2/1996 Kemeny ..... E04H 9/022
248/632
5,553,911 A * 9/1996 Bodin ..... B62D 33/0604
180/89.12
5,971,347 A * 10/1999 Tsai ..... F16F 15/02
248/618
6,343,782 B1 * 2/2002 Honlinger ..... F16F 7/108
248/634
6,679,012 B1 * 1/2004 Chen ..... E04H 9/02
108/158.12
6,851,506 B2 * 2/2005 Bovio ..... B60K 13/04
180/296
7,399,517 B2 * 7/2008 Wang ..... A43B 13/181
248/562
7,637,472 B2 * 12/2009 Endo ..... B60K 13/04
180/309
8,152,146 B2 4/2012 Rodecker
8,376,331 B2 2/2013 Rodecker

* cited by examiner

MUFFLER HANGER

INCORPORATED BY REFERENCE

The disclosures of Japanese Patent Application Nos. 2014-047170 filed on Mar. 11, 2014 and 2015-006148 filed on Jan. 15, 2015, each including the specification, drawings and abstract is incorporated herein by reference in its entirety.

BACKGROUND OF THE INVENTION

1. Field of the Invention

The present invention relates to a muffler hanger for suspending a muffler constituting the exhaust system of a vehicle in a vehicle body.

2. Description of the Related Art

From the past, muffler hangers have been known with which a muffler provided for the exhaust system of an automobile or the like is supported hung on the automobile underfloor or the like. As the muffler hanger, for example, as disclosed in U.S. Pat. No. 5,050,837, known is an item that is a rubber elastic body exhibiting an overall θ shape, and by both the upper and lower end parts being attached to each one of the vehicle body and the muffler, the muffler is elastically suspended on the vehicle body.

However, there were cases when there was a demand for hard spring characteristics in the vehicle front-back direction to align and hold the muffler in the front-back direction of the vehicle in relation to the vehicle body, and there was a demand for soft spring characteristics in the vehicle lateral direction and vertical direction to obtain a vibration isolation operation effect.

However, with the constitution noted in U.S. Pat. No. 5,050,837, not only in the vehicle vertical direction and lateral direction, but also in the front-back direction, the shear spring component becomes dominant with the spring characteristics, so it was difficult to set the spring to be hard in the front-back direction.

Also, with the muffler hanger of U.S. Pat. No. 5,050,837, while a displacement regulating means is provided for limiting the approaching displacement volume of the vehicle body and the muffler, a means for limiting the separation displacement volume of the vehicle body and the muffler is not provided, and there is the risk that if the vertical direction spring is set to be soft, the durability will be insufficient. Similarly, in the lateral direction of a vehicle for which the vertical direction spring is set to be soft as well, since the displacement regulating means is not provided, there are cases when sufficient durability in relation to large load input cannot be ensured.

In light of that, the muffler hanger of Japanese Unexamined Patent Publication No. JP-A-2010-242606 is constituted with a rubber elastic body that is attached to the muffler fixed to the inner surface of a tube-shaped metal fitting attached to the vehicle body, and by an attachment part to the muffler with the rubber elastic body abutting the inner surface of the metal fitting, the vertical direction and lateral direction displacement are regulated.

However, with the constitution of JP-A-2010-242606, since the spring characteristics in the front-back direction of the vehicle are mainly the shear spring component of the rubber elastic body, it is difficult to set the spring to be hard in the front-back direction, and it was difficult to effectively obtain the target spring characteristics.

SUMMARY OF THE INVENTION

It is therefore one object of the present invention to provide a muffler hanger of novel structure for which it is possible, while setting the spring to be soft for two directions, to set the spring of the other direction to be relatively hard, and also possible to limit the relative displacement volume of the muffler in relation to the vehicle body in the two directions for which a soft spring is set.

The above and/or optional objects of this invention may be attained according to at least one of the following modes of the invention. The following modes and/or elements employed in each mode of the invention may be adopted at any possible optional combinations.

Specifically, a first mode of the present invention provides a muffler hanger for suspending a muffler on a vehicle body, comprising: a rigid displacement suppress member integrally provided with upper and lower support parts that extend in parallel while being separated vertically, and a junction part that joins the upper and lower support parts to each other at their lengthwise middle parts, the displacement suppress member being configured to attach to one of the vehicle body and the muffler; and mounting rubbers that connect the upper and lower support parts to each other at lengthwise both sides of the displacement suppress member, each of the mounting rubbers including a pair of arch shaped parts projecting in a direction of mutual separation, and each of the arch shaped parts having a mounting hole piercing therethrough, wherein the mounting rubbers provided to the lengthwise both sides of the displacement suppress member are configured to attach to another of the vehicle body and the muffler by inserting mounting parts each provided to the other of the vehicle body and the muffler into the corresponding mounting hole, and with the mounting parts inserted in the arch shaped parts of the respective mounting rubbers such that the mounting parts are arranged between the upper and lower support parts at both sides of the junction part, a displacement regulator that limits a relative displacement volume of the muffler in relation to the vehicle body is constituted by abutment of the mounting parts against the displacement suppress member.

With this kind of muffler hanger constituted according to the first mode, the mounting rubbers are constituted by a pair of arch shaped parts respectively having an arch shape, so soft spring characteristics using the shear spring component of the fixing end part is realized in relation to input in the vertical direction and the support part extending direction (lengthwise direction), and a vibration isolation effect is effectively exhibited. On the other hand, in the direction orthogonal to both the vertical direction and the support part extending direction, hard spring characteristics are realized using the compression spring component of the fixing end part positioned at both sides of the arch shaped part in relation to vibration input, and the relative displacement volume of the muffler in relation to the vehicle body is limited. In this way, with the muffler hanger of this mode, with a simple constitution, it is possible to realize both a vibration isolation effect using low spring characteristics in two directions, and a displacement regulating effect using high spring characteristics in the other one direction.

In fact, the mounting rubbers each comprising a pair of arch shaped parts arranged so as to project to each side orthogonal to both the vertical direction and the support part extending direction are provided on the respective both end parts positioned at lengthwise both sides of the support part. By so doing, it is possible to support the muffler with good balance with both end parts of the support part, and it is also possible to realize hard spring characteristics for both sides of the direction orthogonal to the vertical direction and the support part extending direction, and to reduce the muffler displacement volume.

Furthermore, in the two directions for which soft spring characteristics are set, the displacement regulator that limits the relative displacement volume of the muffler in relation to the vehicle body is constituted by abutment between the rigid displacement suppress member and the mounting part, so excessive deformation of the mounting rubber is prevented, and sufficient durability is ensured while soft spring characteristics are set.

A second mode of the present invention provides the muffler hanger according to the first mode, wherein the junction part of the displacement suppress member includes an attachment part configured to attach to the vehicle body.

With this mode, it is also possible to attach and support the muffler hanger on the vehicle body at a well-balanced position that is roughly the lengthwise center position of the displacement suppress member, for example.

A third mode of the present invention provides the muffler hanger according to the first mode, wherein one of the upper and lower support parts of the displacement suppress member includes an attachment part configured to attach to the vehicle body.

With this mode, it is possible to support the muffler hanger on the vehicle body with a higher level of stability for example by overlapping the support part of the displacement suppress member on the vehicle body, or by fixing it to the vehicle body at a plurality of locations in the support part lengthwise direction.

A fourth mode of the present invention provides the muffler hanger according to the third mode, wherein the attachment part comprises a mounting bolt implanted in the one of the upper and lower support parts.

With this mode, the work of attaching the displacement suppress member to the vehicle body is easy, and it is possible to fix it tightly. It is also possible to project and attach a plurality of mounting bolts from the support part of the displacement suppress member. Also, it is preferable to provide the mounting bolts in a state projecting from one of the upper and lower support parts toward the opposite side of the other support part, and by doing that, it is possible to attach to the vehicle body surface with mounting bolts in a state aligned even more accurately and to fix this tightly.

A fifth mode of the present invention provides the muffler hanger according to any of the first through fourth modes, wherein the mounting rubbers are configured to attach to the muffler by each of the mounting parts of the muffler being inserted in the mounting hole of the corresponding mounting rubber, both lengthwise end parts of the upper support part of the displacement suppress member project upward above the middle part so as to constitute thick fixing parts that are thick vertically, top end parts of the pair of arch shaped parts that constitute each of the mounting rubbers are fixed to a top part of the corresponding thick fixing part, and bottom end parts of the pair of arch shaped parts that constitute each of the mounting rubbers are fixed to a top part of a corresponding lengthwise end part of the lower support part.

With the muffler hanger of this mode, since the free length of the upper part with the mounting rubber is ensured to be large, in a state mounted on the vehicle, the burden support load of the muffler weight acts downward on the mounting rubber, and can be widely dispersed even if tensile stress occurs on the upper part of each arch shaped part, so durability can be sufficiently ensured. On the other hand, for the lower part of each arch shaped part for which it is difficult for tensile stress to occur due to the burden support load, it is desirable to advantageously obtain compression spring in the direction orthogonal to both directions of the vertical direction and the support part extension direction by having a shape that extends in a direction close to horizontal.

A sixth mode of the present invention provides the muffler hanger according to any of the first through fifth modes, wherein the displacement suppress member is formed using synthetic resin.

With this mode, there is a significant lightening of weight compared to displacement suppress members made of metal or the like. Furthermore, it is possible to easily form the displacement suppress member with a large degree of freedom for the shape. Also, by using the fourth mode combined with this mode, it is possible to easily implant the implanting bolts in the displacement suppress member by fixing mounting bolts simultaneous with setting and forming of the mounting bolts in advance in the forming die of the displacement suppress member.

A seventh mode of the present invention provides the muffler hanger according to any of the first through sixth modes, wherein middle parts of the pair of arch shaped parts that constitute the mounting rubber are connected to each other by a tube-shaped connecting part, and the connecting part includes a center hole that constitutes the mounting hole.

With this mode, the middle parts of the pair of arch shaped parts constituting the mounting rubber are mutually joined and reinforced by the connecting part in the thickness direction, so the deformation rigidity of the middle part of the mounting rubber is increased in relation to input in the direction orthogonal to the junction part and the support part, and hard spring characteristics are effectively exhibited. Also, since mounting holes are formed so as to pierce the pair of arch shaped parts and the connecting part, insertion of the mounting part into the mounting hole is easy, and the work of attaching to the vehicle is simple.

An eighth mode of the present invention provides the muffler hanger according to any of the first through seventh modes, wherein a thickness of the pair of arch shaped parts that constitute the mounting rubber is larger at a middle part than at both end parts fixed to the upper and lower support parts.

With this mode, since high deformation rigidity is ensured in the thickness direction at the middle part of the pair of arch shaped parts constituting the mounting rubber, during input in the direction orthogonal to both of the vertical direction of the junction part and the lengthwise direction of the support parts (thickness direction), in relation to the deformation volume that is roughly the compression direction at both upper and lower parts of the mounting rubber, there is prevention of a marked increase in the deformation volume that is the roughly shear direction at the middle part of the mounting rubber, and it is possible to effectively obtain hard spring characteristics.

A ninth mode of the present invention provides the muffler hanger according to any of the first through eighth modes, wherein the mounting rubbers provided at the lengthwise both sides of the displacement suppress member are integrally formed by being connected to each other via a coating rubber that covers a lengthwise middle part of the displacement suppress member.

With this mode, it is possible to integrally form the mounting rubbers provided at lengthwise both sides of the displacement suppress member, and also, for example, possible to easily realize formation of a shock absorbing rubber layer integrally at the site of the displacement suppress member that constitutes a stopper mechanism by being struck by the mounting part.

A tenth mode of the present invention is the muffler hanger according to any of the first through ninth modes, wherein the mounting rubbers provided at the lengthwise both sides of the displacement suppress member are connected to each other by a connecting rubber extending in a lengthwise direction along the displacement suppress member at inner circumference corner parts on both upper and lower end parts of each of the arch shaped parts that are opposite in the lengthwise direction of the displacement suppress member.

With this mode, at both upper and lower end parts of the arch shaped part for which stress occurs in concentration easily during vibration input in the vertical direction, the inner circumference corner parts for which it is difficult to set an R surface due to the die cutting structure of the forming die are mutually connected via the connecting rubber. Because of that, the inner circumference corner parts with both upper and lower end parts of each arch shaped part substantially disappear, and problems such as the occurrence of cracks due to stress concentration during vibration input and the like are avoided without bringing a more complex die structure or the like, and it is possible to improve durability.

With the present invention, the mounting rubbers fixed to the displacement suppress member are constituted by a pair of arch shaped parts, and since they project to each side orthogonal to the junction part of the displacement suppress member and the support part, with the extending direction of the junction part and the support part, soft spring characteristics are realized by the shear spring component of the fixing end part with the mounting rubbers, and with the direction orthogonal to the junction part and the support part (thickness direction), hard spring characteristics are realized using the compression spring component with both end parts of each arch shaped part. Furthermore, with each extending direction (vertical direction and lateral direction) of the junction part and the support part for which a soft spring is set, the displacement suppress member is constituted by abutment between the mounting part extending from the vehicle side and the displacement suppress member, and excess deformation of the mounting rubber is prevented, thus improving durability.

BRIEF DESCRIPTION OF THE DRAWINGS

The foregoing and/or other objects, features and advantages of the invention will become more apparent from the following description of a preferred embodiment with reference to the accompanying drawings in which like reference numerals designate like elements and wherein.

DETAILED DESCRIPTION OF PREFERRED EMBODIMENTS

Figure 1:
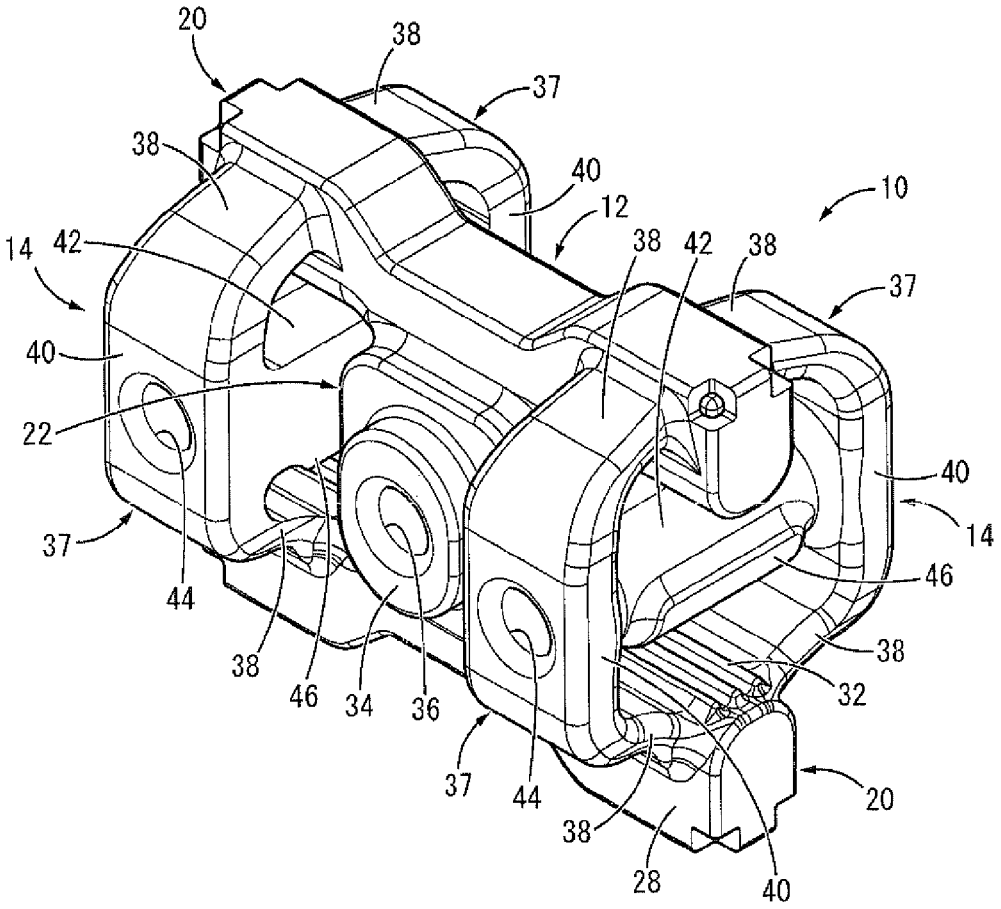
FIG. 1 is a perspective view showing a muffler hanger as a first embodiment of the present invention.

Following, we will describe embodiments of the present invention while referring to the drawings.

Figure 2:
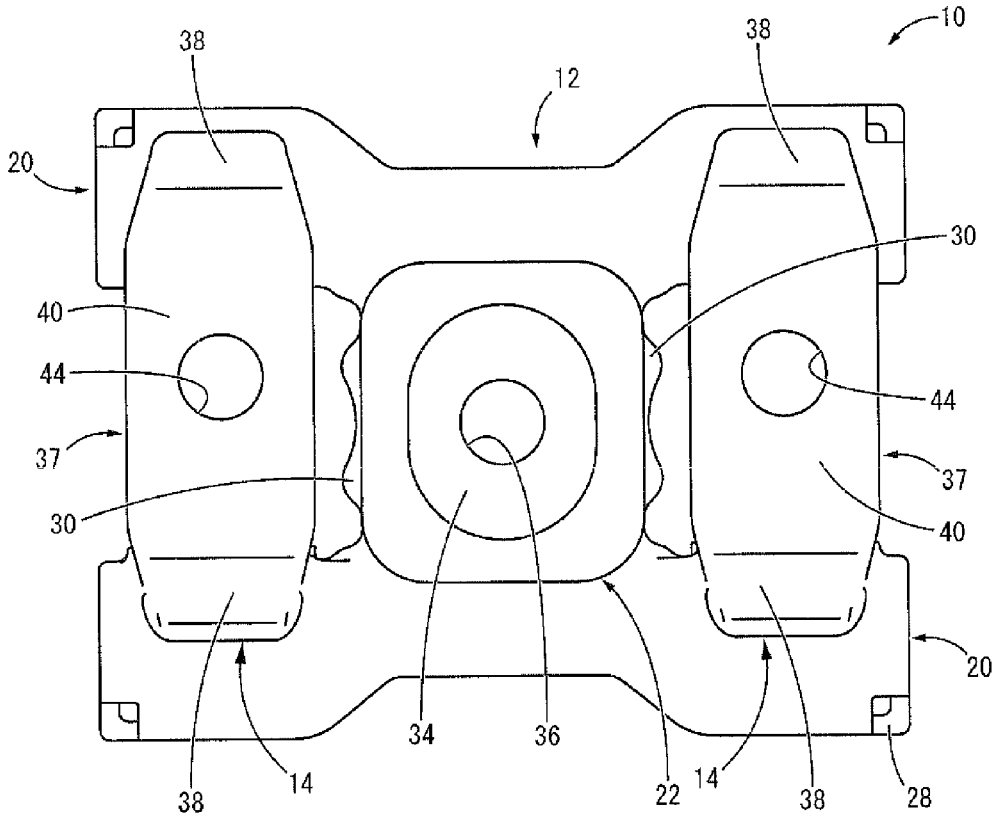
FIG. 2 is a front view of the muffler hanger shown in FIG. 1.
Figure 3:
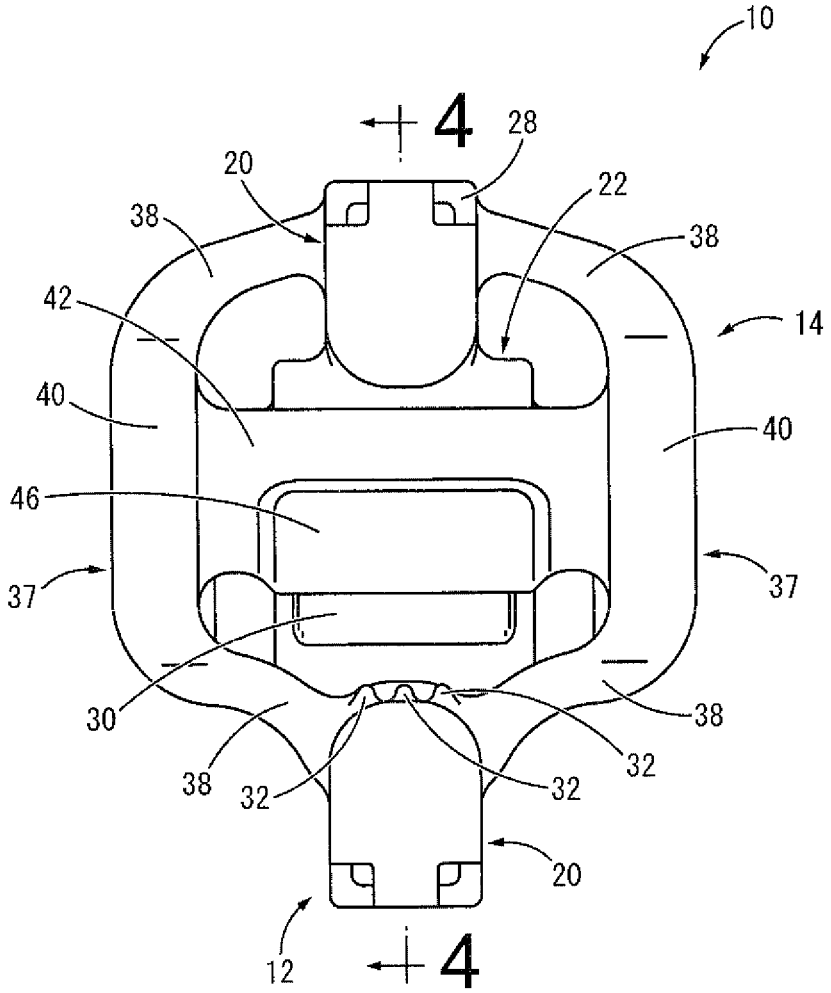
FIG. 3 is a left side view of the muffler hanger shown in FIG. 1.

FIGS. 1 through 3 show a muffler hanger 10 as a first embodiment of the present invention. The muffler hanger 10 has a constitution in which two mounting rubbers 14, 14 are fixed to a rigid displacement suppress member 12, and by the displacement suppress member 12 being attached to a vehicle body 16 and the mounting rubbers 14, 14 being attached to a muffler 18, the muffler 18 is elastically suspended on the vehicle body 16. With the description hereafter, unless there is a specific description, the front-back direction means the lateral direction in FIG. 3 that is the vehicle front-back direction in the vehicle mounted state, the vertical direction means the vertical direction in FIG. 2 that is the vehicle vertical direction in the vehicle mounted state, and the lateral direction means the lateral direction in FIG. 2 that is the vehicle lateral direction in the vehicle mounted state.

Figure 4:
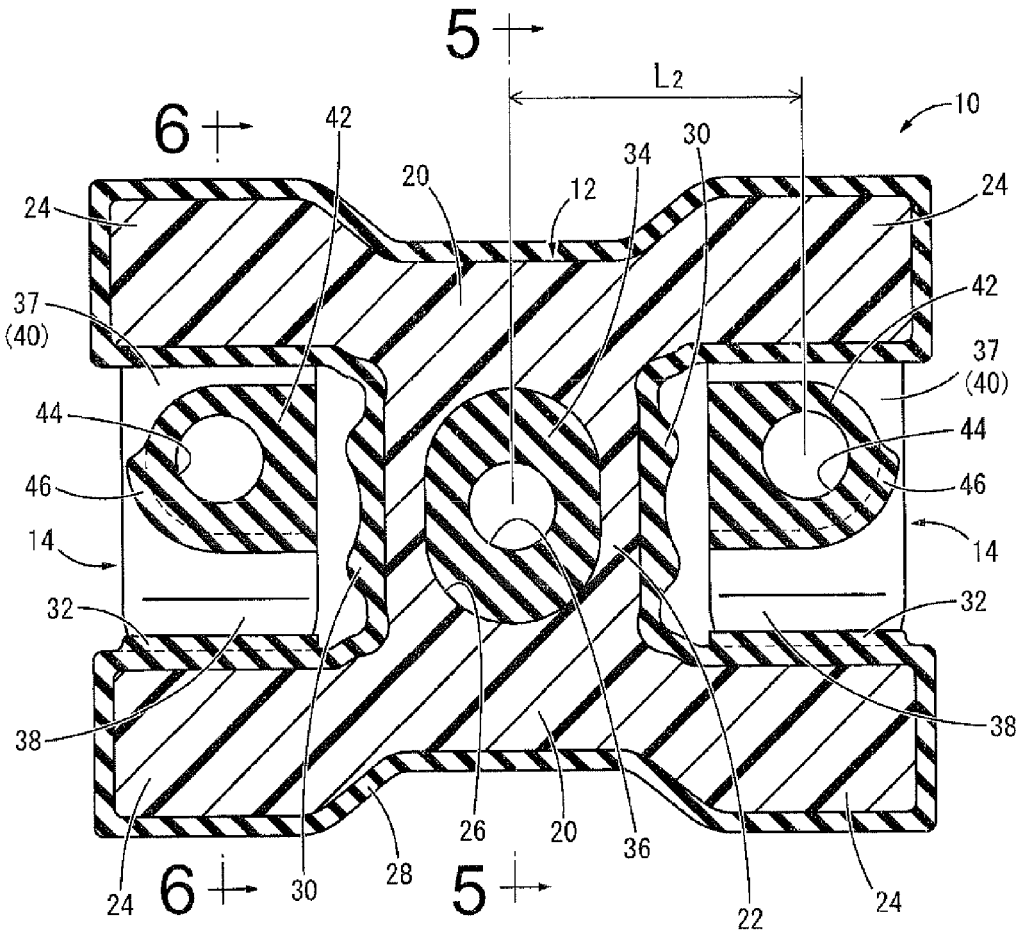
FIG. 4 is a cross section view taken along line 4-4 of FIG. 3.

In more detail, the displacement suppress member 12 is a rigid member formed using synthetic resin, and as shown in FIG. 4, overall has roughly an overturned H shape, and is integrally equipped with a pair of support parts 20, 20 extending mutually in parallel while being separated vertically, and a junction part 22 that joins those to each other at the center part of the lateral direction which is the lengthwise direction of the pair of support parts 20, 20.

The support part 20 has a rod shape extending linearly in the lateral direction, with the top and bottom outer surfaces broadening front to back in a roughly fixed cross section shape, and the top and bottom inner surfaces having a roughly arc shaped curved surface that slants vertically inward as it goes to the front-back center. Furthermore, provided at both end parts in the lateral direction of the support part 20 are thick fixing parts 24 that are thick in the vertical direction and project vertically outward compared to the middle part.

Figure 5:
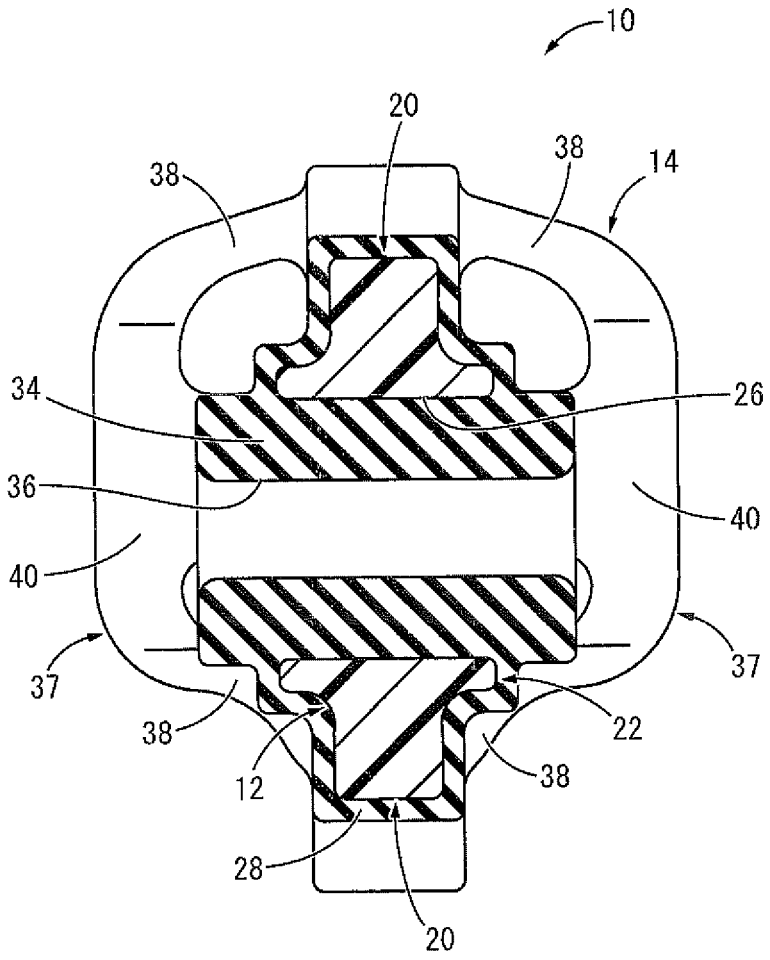
FIG. 5 is a cross section view taken along line 5-5 of FIG. 4.

The junction part 22 has a roughly rectangular block shape or a flat plate shape extending linearly in the vertical direction, with the top and bottom end parts integrally connected with the pair of upper and lower support parts 20, 20, and as shown in FIG. 5, the front-back direction dimension (thickness dimension) is made larger than that of the pair of support parts 20, 20 so as to project to both front and back sides. Furthermore, an oblong, roughly oval cross section shaped insertion hole 26 that pierces in the front-back direction at roughly the center part is formed on the junction part 22.

The forming material of the displacement suppress member 12 is not particularly restricted, but for example a general PA type resin such as polyamide (hereafter PA) 6, PA66 or the like can be suitably used. Also, the forming materials noted above can be used individually or in a combination of two or more types. Furthermore, it is possible to increase the strength by adding glass fiber or the like to the synthetic resin material noted above. And furthermore, the forming material of the displacement suppress member 12 is not limited to being a thermoplastic synthetic resin, and a thermosetting synthetic resin can also be used. In addition, it is preferable that the displacement suppress member 12 be made of synthetic resin in light of the goal of being lighter and the like, but it is also possible to form it using a metal such as iron, an aluminum alloy or the like.

Figure 6:
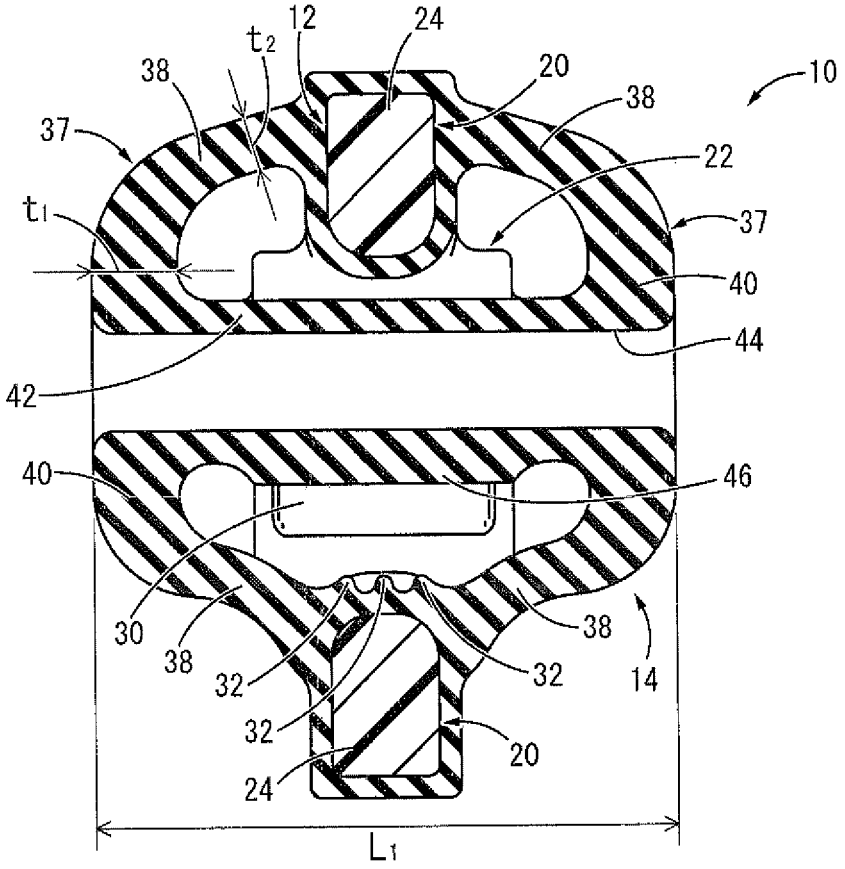
FIG. 6 is a cross section view taken along line 6-6 of FIG. 4.

Also, the displacement suppress member 12 has roughly the entire surface covered by a coating rubber 28. Furthermore, first shock absorbing rubbers 30 are respectively provided at both the left and right side surfaces of the junction part 22, and a second shock absorbing rubber 32 is provided on the top surface of the lower support part 20. As shown in FIG. 4, the first shock absorbing rubbers 30 are integrally formed with the coating rubber 28, and are thicker than the coating rubber 28. With this embodiment, the center parts in the vertical direction have a recessed shape with a smaller projection height than both end parts, and each of the upper and lower sides extends in the front-back direction in a mountain shaped cross section. Meanwhile, as shown in FIGS. 4 and 6, the second shock absorbing rubber 32 is integrally formed with the coating rubber 28 covering the top surface at both left and right end parts of the lower support part 20, and has a projecting shape extending laterally projecting facing upward, and with this embodiment, is formed with three strips in parallel at a designated interval in the front-back direction.

Furthermore, as shown in FIGS. 4 and 5, on the inner circumference surface of the insertion hole 26 formed on the displacement suppress member 12, a center fitting rubber 34 integrally formed with the coating rubber 28 is attached. The center fitting rubber 34 fills the insertion hole 26, and also projects further outward front to back than the junction part 22. Furthermore, a body mounting hole 36 having a roughly circular cross section that pierces the center part is formed on the center fitting rubber 34. Specifically, with this embodiment, at the junction part 22 of the displacement suppress member 12, the attachment part to the vehicle body side is constituted including the body mounting hole 36.

Also, mounting rubbers 14, 14 are fixed to lengthwise both sides (both lateral end parts) on the pair of upper and lower support parts 20, 20 of the displacement suppress member 12. The mounting rubbers 14 are overall ring shaped rubber elastic bodies integrally formed with the coating rubber 28, and are fixed to the upper and lower support parts 20, 20 of the displacement suppress member 12 at both upper and lower parts in the radial direction.

Specifically, the mounting rubbers 14 are constituted positioned so as to sandwich the displacement suppress member 12 from both sides in the thickness direction, and so as to include a pair of arch shaped parts 37, 37 bulging in the direction of mutual separation facing both sides in the thickness direction from the upper and lower support parts 20, 20. Each of the arch shaped parts 37 has the middle part extending roughly in the vertical direction, and both upper and lower parts extending at a slant facing the support parts 20. Also, regarding the arch shaped part 37, both upper and lower parts constitute fixing end parts 38, 38 fixed to the corresponding one of the pair of support parts 20, 20, and the middle part constitutes a pillar shaped or plate shaped middle attachment plate part 40.

The fixing end parts 38 project front and back while slanting in the direction approaching the displacement suppress member 12 facing inward as it goes toward the tip upward or downward, and also, with this embodiment, they gradually broaden in width in the lateral direction as they approach the middle attachment plate part 40 that is positioned in the front-back outward direction (see FIG. 2). With this embodiment, the upper fixing end part 38 has a convex curved shape facing front-back outward and upward along the overall form, whereas the lower fixing end part 38 has a convex curved shape facing front-back outward and downward at both end parts, and also has a concave curved shape opening front-back outward and downward at the middle part.

The middle attachment plate part 40 extends vertically with a roughly fixed width dimensions in the lateral direction, and by the middle attachment plate part 40 being integrally formed with the upper and lower fixing end parts 38, 38, a convex arch shape is constituted curved in the thickness direction and facing front-back outward. With each arch shaped part 37 constituting the mounting rubber 14, the thickness dimension (t1) of the middle attachment plate part 40 is larger than the thickness dimension (t2) of the fixing end part 38 (t1>t2), and with this embodiment, in combination with the fact that the average width dimension of the middle attachment plate part 40 is larger than that of the fixing end part 38, the cross section area is larger, and in the lateral and vertical directions, the deformation rigidity of the middle attachment plate part 40 is greater than the deformation rigidity of the fixing end parts 38.

The arch shaped parts 37 with structure as described above have each tip of the upper and lower fixing end parts 38, 38 fixed to the corresponding one of the upper and lower pair of support parts 20, 20, and extend straddling between the upper and lower pair of support parts 20, 20. With this embodiment, the upper fixing end part 38 is fixed to the top end part of the thick fixing part 24 of the upper support part 20, so that a great free length is ensured. Meanwhile, the lower fixing end part 38 is fixed to the top end part of the thick fixing part 24 of the lower support part 20, so that the free length is relatively smaller.

Furthermore, by the front-back pair of arch shaped parts 37, 37 being provided at the respective front and back sides of the displacement suppress member 12, and mutually arranged to be roughly symmetrical, the mounting rubber 14 is constituted with a roughly ring shaped structure overall as with the side view shown in FIG. 3, and two mounting rubbers 14 are provided so as to form a pair respectively fixed to both lateral end parts of the support part 20. Specifically, each fixing end part 38 of the front-back pair of arch shaped parts 37, 37 extends facing front-back outward from the respective front and back surfaces of the displacement suppress member 12, and the arch shaped parts 37, 37 project to the front and back of the displacement suppress member 12 and make a convex form facing front-back outward. With this embodiment, the front-back pair of arch shaped parts 37, 37 project in mutually symmetrical arch shapes at both front-back sides of the displacement suppress member 12.

Also, with each mounting rubber 14, the middle attachment plate parts 40, 40 of the front-back pair of arch shaped parts 37, 37 are joined to each other by a connecting part 42.

The connecting part 42 is formed with a tube-shaped rubber elastic body, and extends front and back in a straight shape between facing surfaces of the front-back pair of middle attachment plate parts 40, 40, so as to be integrally formed with the front-back pair of middle attachment plate parts 40, 40. The connecting parts 42, 42 formed on the respective mounting rubbers 14, 14 provided at both lateral sides extend front and back on left and right sides of the junction part 22 of the displacement suppress member 12, and are arranged between the upper and lower pair of support parts 20, 20. Also, a muffler mounting hole 44 pierces through the middle attachment plate parts 40, 40 and the connecting part 42 in the front-back direction and extends in a roughly fixed circle cross section. A third shock absorbing rubber 46 is integrally formed at the bottom part of the connecting part 42, and the bottom part is thicker than the top part. Also, as shown in FIG. 4, with the connecting part 42 of this embodiment, the outer circumference surface of the lateral exterior is a curved surface having a roughly arch shaped cross section, and the outer circumference surface of the lateral interior is roughly a plane that expands roughly orthogonally to the lateral direction.

Figure 7:
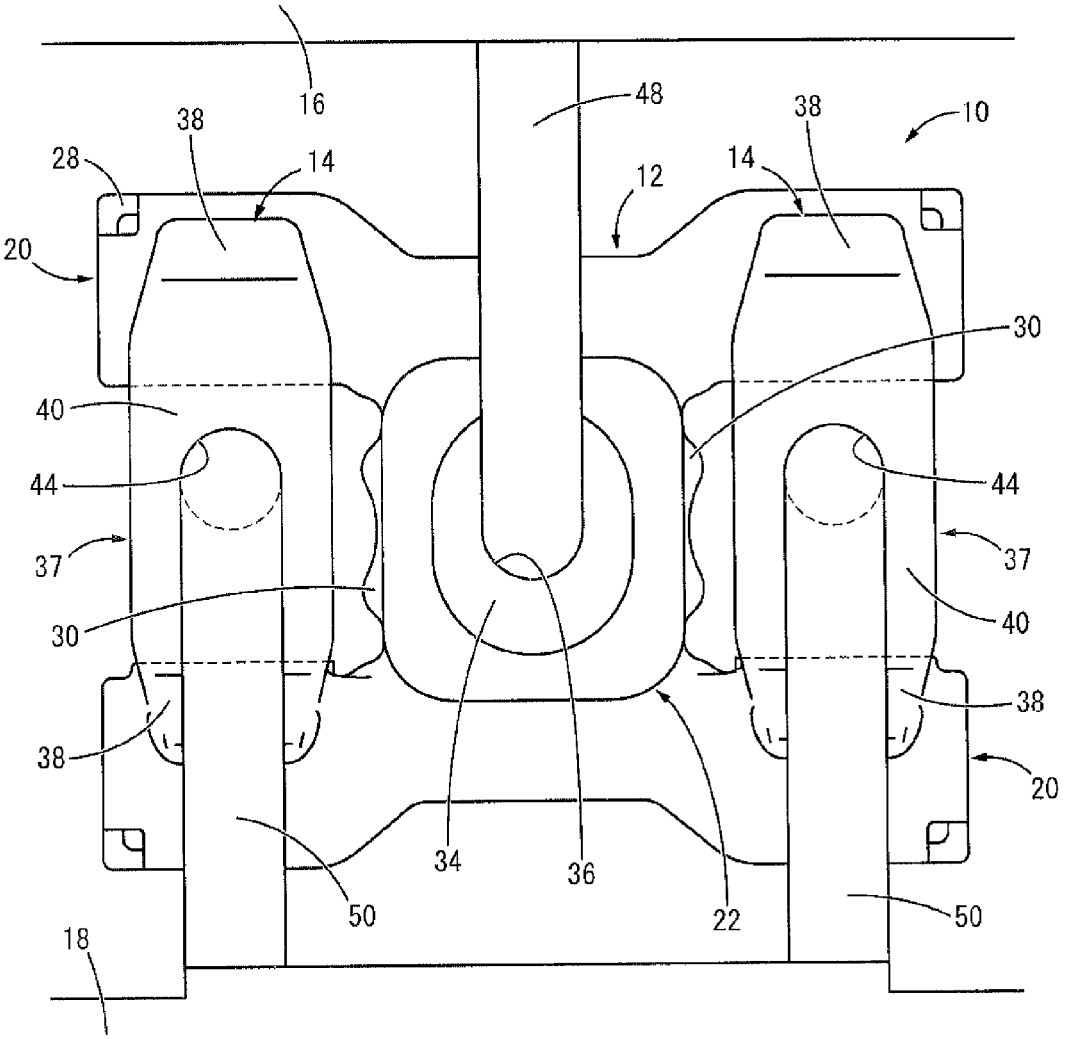
FIG. 7 is a front view of the muffler hanger shown in FIG. 1 mounted on a vehicle.
Figure 8:
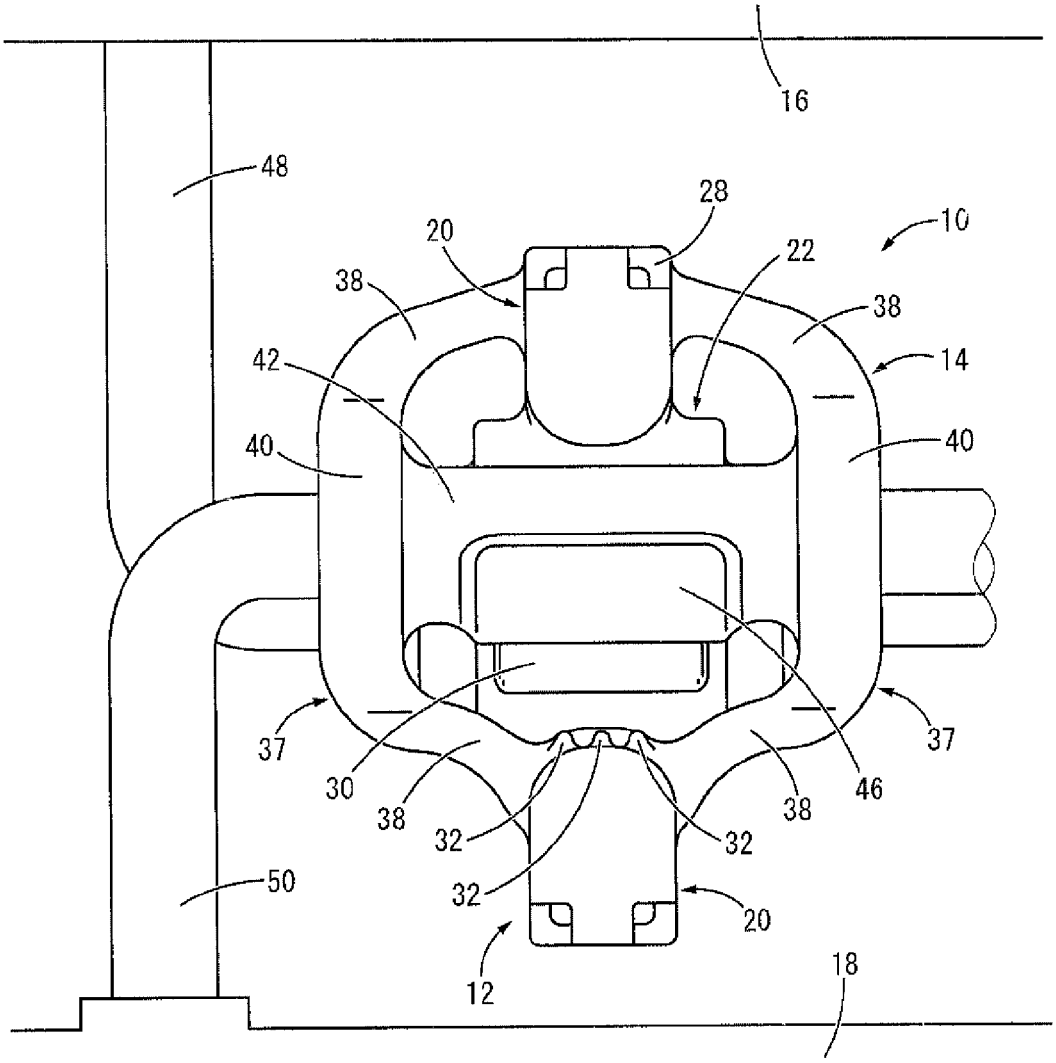
FIG. 8 is a right side view of the muffler hanger shown in FIG. 7 mounted on the vehicle.

As shown in FIGS. 7 and 8, the muffler hanger 10 constituted in this way is mounted on a vehicle. Specifically, a body side mounting pin 48 projecting from a vehicle body 16 is inserted in an insertion hole 26 of the displacement suppress member 12 on which is fixed the center fitting rubber 34, and fitted into the body mounting hole 36 of the center fitting rubber 34 that opens to the inside of the insertion hole 26. By so doing, the junction part 22 of the displacement suppress member 12 is attached to the vehicle body 16. Meanwhile, muffler side mounting pins 50, 50 serving as mounting parts projecting from the muffler 18 are inserted in the left and right muffler mounting holes 44, 44 that pierce through the front-back pair of middle attachment plate parts 40, 40 and the connecting part 42, and by so doing, the pair of mounting rubbers 14, 14 are attached to the muffler 18 at both the left and right sides. By so doing, in a state with the muffler hanger 10 mounted on the vehicle, the muffler 18 is suspended from the vehicle body 16 via the muffler hanger 10. With this embodiment, the muffler mounting hole 44 is formed piercing through the front-back pair of middle attachment plate parts 40, 40 and the connecting part 42, and peripheral wall part diameter expansion deformation is allowed relatively easily, so it is possible to easily insert the muffler side mounting pin 50 through the muffler mounting hole 44. Also, since the body mounting hole 36 is also constituted by the center fitting rubber 34, it is possible to easily insert and attach the body side mounting pin 48 in and to the insertion hole 26 of the displacement suppress member 12 based on the elastic deformation of the center fitting rubber 34.

Also, in the vehicle mounted state, the left and right muffler side mounting pins 50, 50 extend front and back on left and right sides of the junction part 22 with the displacement suppress member 12. Furthermore, the left and right muffler side mounting pins 50, 50 extend front and back between the upper and lower pair of support parts 20, 20 of the displacement suppress member 12. In other words, at least a portion of the muffler side mounting pins 50, 50 in the front-back direction is enclosed on three sides of the periphery by the pair of support parts 20, 20 and the junction part 22 of the displacement suppress member 12. The muffler side mounting pins 50, 50 and the connecting parts 42, 42 fitted externally thereon are arranged so as to be separated by a designated distance in relation to the displacement suppress member 12 covered by the coating rubber 28 and the shock absorbing rubbers 30 and 32.

In FIGS. 7 and 8, the illustration omits the deformation of the mounting rubber 14 due to the mass of the muffler 18. When the distributed load of the muffler 18 is input, tensile stress acts on the upper fixing end part 38 of the mounting rubber 14, but with this embodiment, the upper fixing end part 38 is fixed to the top end part of the thick fixing part 24 of the support part 20, and by the free length of the upper fixing end part 38 being ensured to be long, greater durability is ensured due to dispersion of stress or distortion.

Also; in the vehicle mounted state, when vibration in the vertical direction is input between the vehicle body 16 and the muffler 18, mainly the fixing end part 38 of the mounting rubber 14 undergoes shear deformation in the vertical direction, and with the soft spring characteristics of the shear spring component (small spring constant), the target vibration-prevention effect (vibration isolation effect) is effectively exhibited.

Furthermore, during lateral direction vibration input of the muffler 18, mainly the fixing end part 38 of the mounting rubber 14 undergoes shear deformation in the lateral direction, and with the soft spring characteristics of the shear spring component, the target vibration-prevention effect is effectively exhibited. The middle attachment plate part 40 is also able to contribute to the soft spring characteristics since it undergoes shear deformation, but with the mounting rubber 14 of this embodiment, the fixing end part 38 has a gradually narrower width in the lateral direction facing the fixing end to the support part 20, so during lateral direction vibration input, shear deformation of the fixing end part 38 on the mounting rubber 14 is generated ahead of the shear deformation of the middle attachment plate part 40.

Also, during vibration input in the front-back direction, both the upper and lower fixing end parts 38, 38 undergo compression deformation, and the relative displacement volume of the muffler 18 in relation to the vehicle body 16 is limited by the hard spring characteristics (large spring constant) due to the compression spring component.

With this embodiment, the thickness dimension (t1) of the middle attachment plate part 40 is greater than the thickness dimension (t2) of the fixing end part 38 (t1>t2), and in relation to the vibration input in the front-back direction, the deformation rigidity of the middle attachment plate part 40 is greater than the deformation rigidity of the fixing end part 38. By so doing, it is difficult for shear deformation to occur in the thickness direction of the middle attachment plate part 40, and a hard spring is obtained due to compression of the fixing end part 38 in the front-back direction of the vehicle. Therefore, it is possible for the muffler 18 holding performance to be effectively exhibited.

In fact, the front-back pair of middle attachment plate parts 40, 40 are mutually joined by the tube-shaped connecting part 42 extending front and back, and it becomes more difficult for elastic deformation to occur in the thickness direction of the middle attachment plate parts 40, 40 which is the vehicle front-back direction in relation to input in the front-back direction.

In addition, the lower fixing end part 38 of the mounting rubber 14 is fixed to the top end part of the support part 20, and the free length is made shorter than that of the upper fixing end part 38, so a hard spring by the compression spring component in relation to front-back input is effectively exhibited, and the displacement volume of the muffler 18 in the front-back direction is limited. In particular, the middle part of the lower fixing end part 38 has a curved shape that is concave opening downward, and in a deformed state by the distributed load of the muffler 18, it extends front and back in a direction closer to horizontal, so a hard spring by compression in the front-back direction can be more efficiently obtained.

As described above, by having the mounting rubber 14 be an arch shape that is convex facing front-back outward, in two directions of the vehicle (vertical direction and lateral direction), soft spring characteristics are realized by the shear spring component of the mounting rubber 14, and also, in the other one direction of the vehicle (front-back direction), hard spring characteristics are realized by the compression spring component of the mounting rubber 14.

Furthermore, as shown in FIG. 6, the distance between the front-back outer surfaces of the pair of mounting rubbers 14, 14, said another way, the length of the muffler mounting hole 44 (L1) is made sufficiently large. By so doing, when both lateral ends in FIG. 6 are vertically displaced relatively and the muffler side mounting pin 50 inserted in the muffler mounting hole 44 undergoes prizing displacement vertically with a tilt, the mounting rubber 14 is compressed in the lengthwise direction, exhibiting relatively hard spring characteristics due to the compression spring component, whereby the deflection of the muffler 18 to the prizing direction is limited. In other words, during prizing displacement, a load that is roughly in the axis direction is applied to the mounting rubbers 14, 14 that are roughly arch shaped, so by compression and pulling direction deformation being actively generated also on the upper and lower fixing end parts 38, 38, an effective displacement regulating function is exhibited.

Also furthermore, as shown in FIG. 4, since the distance (L2) from the mounting portion to the vehicle body 16 (body mounting hole 36) to the mounting portion onto the muffler 18 (muffler mounting hole 44) is ensured to be large, when the muffler 18 is displaced in the circumference direction around the body mounting hole 36, and the mounting rubber 14 is elastically deformed so that the line that connects the centers of the pair of muffler mounting holes 44, 44 in FIG. 4 is tilted, it is possible to obtain a hard spring, and the displacement volume of the muffler 18 is limited.

Also, with the two vehicle directions for which a soft spring is set (vertical direction and lateral direction), the displacement regulator that limits the relative displacement volume of the muffler 18 in relation to the vehicle body 16 is constituted efficiently and effectively.

Specifically, in the vehicle mounted state of the muffler hanger 10, the muffler side mounting pin 50 is inserted in an insertion state between the facing parts of the upper and lower pair of support parts 20, 20 of the displacement suppress member 12, and is positioned at roughly the center between the support parts 20, 20 in a mounted state with the muffler support load input. Therefore, during large load input in the vertical direction, by abutment between the muffler side mounting pin 50 and the support part 20, the vertical displacement regulator that limits the relative displacement volume of the muffler 18 and the vehicle body 16 in the vertical direction is constituted.

Meanwhile, the pair of muffler side mounting pins 50, 50 are arranged so as to be separated by a designated distance at left and right sides of the junction part 22 of the displacement suppress member 12. Then, during large load input in the lateral direction, by abutment between the muffler side mounting pin 50 and the junction part 22, the lateral displacement regulator that limits the relative displacement volume of the muffler 18 and the vehicle body 16 in the lateral direction is constituted.

With this embodiment, by the muffler side mounting pin 50 being inserted into the muffler mounting hole 44, the connecting part 42 formed by the rubber elastic body covers the outer circumference surface of the muffler side mounting pin 50, and the surface of the displacement suppress member 12 is covered by the coating rubber 28. By so doing, in the displacement regulator, the muffler side mounting pin 50 and the displacement suppress member 12 are abutted with shock absorption via the rubber elastic body, and by decreasing the impact during abutment when doing displacement regulation, there will be a decrease in striking noises, adverse effects on ride comfort and the like. In particular, in directions for which it is easy for the impact during abutment to be large, the coating rubber 28 is made thicker in parts to form the first shock absorbing rubber 30 and the second shock absorbing rubber 32, while the connecting part 42 is made thicker in parts to form the third shock absorbing rubber 46, so the cushioning action during abutment is effectively exhibited.

Furthermore, since the displacement suppress member 12 is formed using synthetic resin, it is possible to obtain a light weight muffler hanger 10 of the present invention.

Above, we gave a detailed description of the embodiment of the present invention, but the present invention is not limited to that specific description. For example, the displacement suppress member 12 is not limited to being made of synthetic resin, and for example can also be formed using metal such as iron, an aluminum alloy or the like, and can also be formed using a rubber or elastomer that is harder than the mounting rubber 14.

The displacement suppress member 12 of the embodiment noted above has a symmetrical shape vertically, front and back, and laterally, but the displacement suppress member does not absolutely have to have a symmetrical shape. For example, with the lower support part 20, by the vertical dimension being made smaller by eliminating the lower edge part of the thick fixing part 24 to which the lower fixing end part 38 is not fixed, it is possible to make it even lighter.

Also, it is possible to have the junction part 22 of the displacement suppress member 12 attached to the muffler 18, and to have the middle attachment plate part 40 of the mounting rubber 14 attached to the vehicle body 16. In this case, since the action direction of the distributed load of the muffler 18 is vertically inverted, it is desirable to have the muffler hanger 10 attached vertically inverted.

Furthermore, with the displacement suppress member 12, in regards to the position of the attachment part attached to one of the vehicle body and the muffler or to the specific attachment constitution, these are not limited to the insertion hole 26 of the junction part 22 shown in the first embodiment or the like. We will describe below a muffler hanger including a different mode of the attachment part of the displacement suppress member 12 as a second embodiment of the present invention while referring to the drawings.

Specifically, a muffler hanger 60 as a second embodiment of the present invention shown in FIGS. 9 through 15, the same as with the first embodiment, has a construction in which mounting rubbers 64, 64 are integrally provided by vulcanized adhesion on a displacement suppress member 62 with an overall roughly I-shaped or overturned H-shaped front surface. With the description below, members and parts with the same constitution as those of the first embodiment will be given the same code number as those of the first embodiment in the drawings, and a detailed description of those will be omitted.

Figure 16:
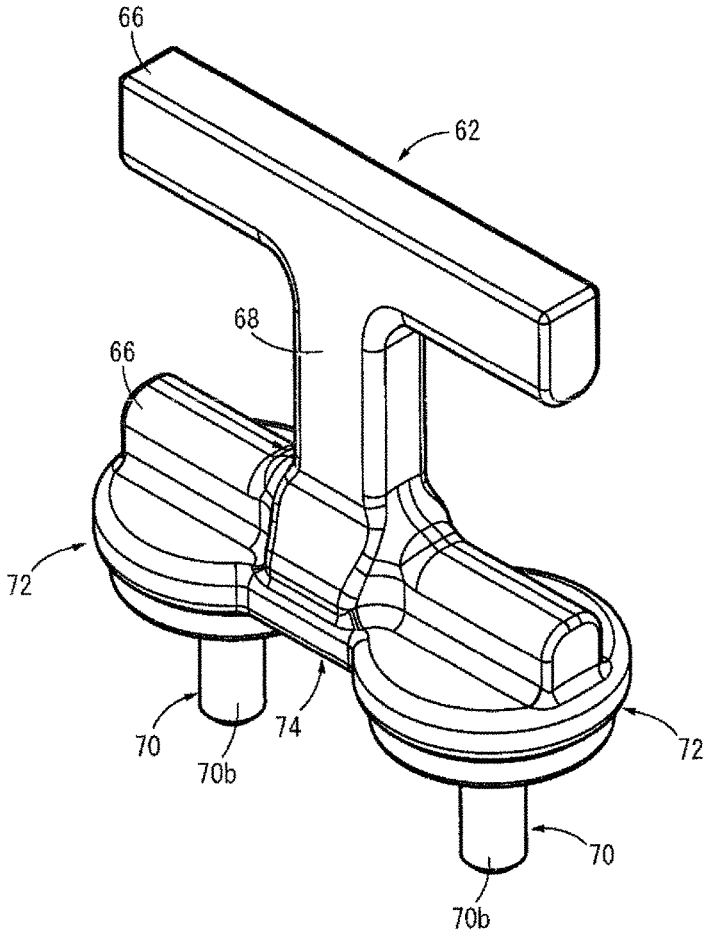
FIG. 16 is a perspective view showing a displacement suppress member constituting the muffler hanger shown in FIG. 9.

Here, the displacement suppress member 62 is equipped with a pair of support parts 66, 66 extending in parallel vertically in roughly the horizontal direction as shown by the constitution before adhesion of the mounting rubbers 64, 64 in FIG. 16, and also, the lengthwise direction center parts of this pair of support parts 66, 66 are integrally joined by a junction part 68.

In particular, with the first embodiment, the constitution is such that the cross section shapes of the pair of support parts 20, 20 and the junction part 22 change in the lengthwise direction, but with this embodiment, each of the pair of support parts 66, 66 and the junction part 68 has a roughly fixed cross section shape along the entire length in the lengthwise direction. Also, the pair of support parts 66, 66 and the junction part 68 are formed with roughly equal thickness dimensions.

Furthermore, with the first embodiment, the insertion hole 26 is formed as the attachment part to the vehicle body positioned at the center part of the junction part 22, but with this embodiment, instead of that, mounting bolts 70, 70 are implanted as attachment parts to the vehicle body positioned at the bottom end part of the lower support part 66. In specific terms, the bottom end part of the support part 66 constitutes a mounting portion 72 with a wide width, and a head part 70*a* of the mounting bolt 70 made of metal is embedded in and fixed to the mounting portion 72, and a leg part 70*b* of the mounting bolt 70 is installed projecting facing downward from the support part 66.

The specific position and number of mounting bolts 70 are not limited, but with this embodiment, at the lower support part 66, each mounting bolt 70 is fixed to the part extending to both the left and right sides of the junction part 68. With the support part 66, the mounting portion 72 to which the mounting bolt 70 is fixed is formed with a roughly circular thick board shape one size larger than the head part 70*a* corresponding to the head part 70*a* of the mounting bolt 70. Also, a lengthwise direction middle portion 74 of the lower support part 66 has a thick walled shape for which the width dimension broadens facing downward so as to connect the mounting portions 72, 72 to which both side mounting bolts 70, 70 are fixed, which improves the strength and rigidity of the support part 66 constituting the attachment part (see FIG. 13).

Also, on the displacement suppress member 62 constituted in this way, the same as with the first embodiment, a rubber elastic body is formed by adhesion so as to cover the surface using vulcanized adhesion. The rubber elastic body fixed to the displacement suppress member 62 is positioned at lengthwise both sides of the displacement suppress member 62, and forms mounting rubbers 64, 64 equipped with a pair of arch shaped parts 37, 37 respectively curved and projecting facing both sides in the front-back direction. Specifically, the mounting rubbers 64 of this embodiment have roughly the same constitution as the mounting rubbers 14 of the first embodiment, and the connecting part 42 is provided straddling between each center part of the pair of arch shaped parts 37, 37, and also the muffler mounting hole 44 is formed piercing through the connecting part 42.

However, with the mounting rubbers 64 of this embodiment, the tip of the upper fixing end part of each arch shaped part 37 is fixed to the middle part in the height direction of the upper support part 66 of the displacement suppress member 62. With this point, there is a difference in constitution from that of the first embodiment for which the tip of the upper fixing end part of each arch shaped part 37 is fixed near the height direction top end of the upper support part 20 of the displacement suppress member 12. In this way, by adjusting the fixing position of the arch shaped part 37 on the support part 66, considering the muffler support load or the elasticity of the mounting rubbers 64, it is possible to suitably perform adjustment setting of the stopper clearance in the vertical direction between the connecting part 42 and the support part 66.

Also, with this embodiment, in the vertical direction stopper mechanism based on abutment between the connecting part 42 and the support part 66, instead of the second shock absorbing rubber 32 comprising a plurality of projections in the first embodiment, a shock absorbing projection 76 that projects facing the connecting part 42 from the support part 66 side is used. In this way, by suitably adjusting the projection height or shape of the shock absorbing projection 76 as the second shock absorbing rubber, it is possible to suitably adjust and set the shock absorbing function or the like of the stopper mechanism.

This kind of shock absorbing projection having any shape can be formed projecting facing the connecting part 42 from the upper support part 66 side, and can be used as the first shock absorbing rubber projecting in the lateral direction facing the connecting part 42 from the junction part 68. In other words, the specific shape, size or the like of the shock absorbing rubber at each part constituting the stopper mechanism is not limited. It is also possible to form the shock absorbing projection to project from the connecting part 42 side. With this embodiment, by making the outer diameter dimension of the axially middle part of the connecting part 42 big to make it thick, there is further improvement in the shock absorbing action during stopper abutment of each direction.

In particular with this embodiment, in contrast to the first embodiment, since the attachment part is not provided at the junction part 68 of the displacement suppress member 62, it is not absolutely necessary to do adhesion formation of the rubber elastic body to the junction part 68. However, with this embodiment, a shock absorbing rubber layer is formed by adhesion also on the outer circumference surface of the junction part 68, and there is an improvement in the reduction effect of shock and noise during the stopper action that comes with abutment of the connecting part 42 in the lateral direction. As the first shock absorbing rubber exhibiting a shock absorbing action in the stopper mechanism in the lateral direction, with the first embodiment, a rubber projection projecting facing the connecting part 42 from the outer circumference surface of the junction part 22 was used, but with this embodiment, a rubber projection 77 projecting facing the junction part 68 which is made by thickening the connecting part 42 to the outer circumference side.

Furthermore, it is sufficient for the rubber elastic body to be equipped with at least the pair of mounting rubbers 64, 64 provided at lengthwise both sides of the displacement suppress member 62, but in particular with this embodiment, the rubber projection 77 and the shock absorbing projection 76 are formed using a rubber elastic body. Also, a rubber elastic body is formed by adhesion also on the lengthwise middle part of the upper and lower support parts 66 of the displacement suppress member 62, and the pair of mounting rubbers 64, 64 are mutually connected and integrally formed by the coating rubber 28 that covers the lengthwise middle part of the upper and lower support parts 66.

In addition, on the coating rubber 28 that is adhered to the lengthwise middle part of the upper and lower support parts 66 to connect the pair of mounting rubbers 64, 64, a connecting rubber 78 that extends in the lengthwise direction along both side surfaces of the upper and lower support parts 66 is integrally formed so as to project from the outer circumference surface. Also, the inner circumference corner parts on both the upper and lower end parts (fixing end parts 38, 38) of the arch shaped parts 37, 37 provided at lengthwise both sides at each support part 66 are mutually connected by this connecting rubber 78.

Figure 15:
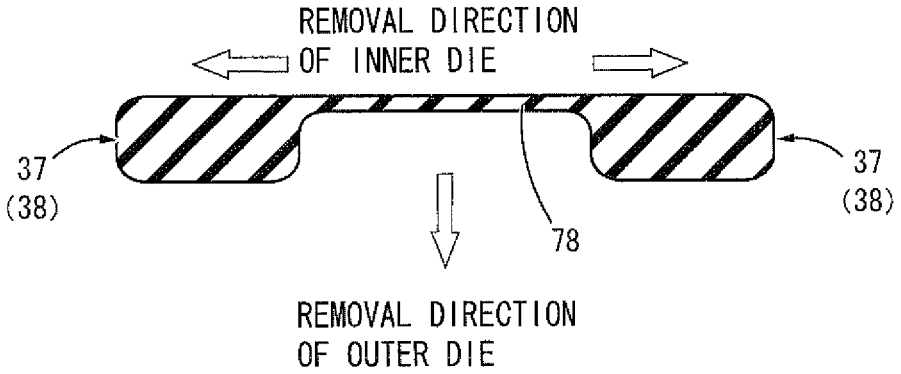
FIG. 15 is a view suitable for explanation corresponding to a cross section view taken along line 15-15 of FIG. 11.

Specifically, the edge of the inner circumference corner parts of the upper and lower fixing end parts 38, 38 of, the arch shaped parts 37, 37 are substantially eliminated with the connecting rubber 78. By so doing, as shown in FIG. 15, for example, for each forming die of the inner circumference side and the outer circumference side of the arch shaped part 37, through demolding by removing the inner die after rubber vulcanized molding in the lateral direction in FIG. 15 and also removing the outer die downward in FIG. 15 or the like, it is possible to easily avoid a shape for which a corner stands out such as a pin corner on the surface of the arch shaped part 37.

As a result, it is possible to easily give a suitable R shape to the corner part of the mounting rubber 64 that undergoes elastic deformation by the vibration load that is applied, and concentration of stress and distortion at the corner parts is avoided, so durability and reliability are improved.

Also, the muffler hanger 60 of this embodiment constituted as described above, the same as with the first embodiment, is mounted between the vehicle body and the muffler, and is made to give vibration-damping support for the muffler in relation to the vehicle body. At this time, the same as with the first embodiment, the muffler is attached by the two muffler side mounting pins serving as mounting parts, which are formed thereon, being inserted in the respective muffler mounting holes 44, 44 of the mounting rubbers 64, 64.

On the other hand, the attachment of the muffler hanger 60 to the mounting unit of the vehicle body differs from the first embodiment in that it is performed by mounting bolts 70 implanted in the displacement suppress member 62. For example, with this embodiment, the displacement suppress member 62 is set in a state placed on a body material such as the member material of the vehicle body, and the leg parts 70*b*, 70*b* of the mounting bolts 70, 70 are inserted through the bolt mounting holes provided piercing the body material, and fixed by tightening with a nut, whereby the displacement suppress member 62 of the muffler hanger 60 is attached to the vehicle body.

Figure 9:
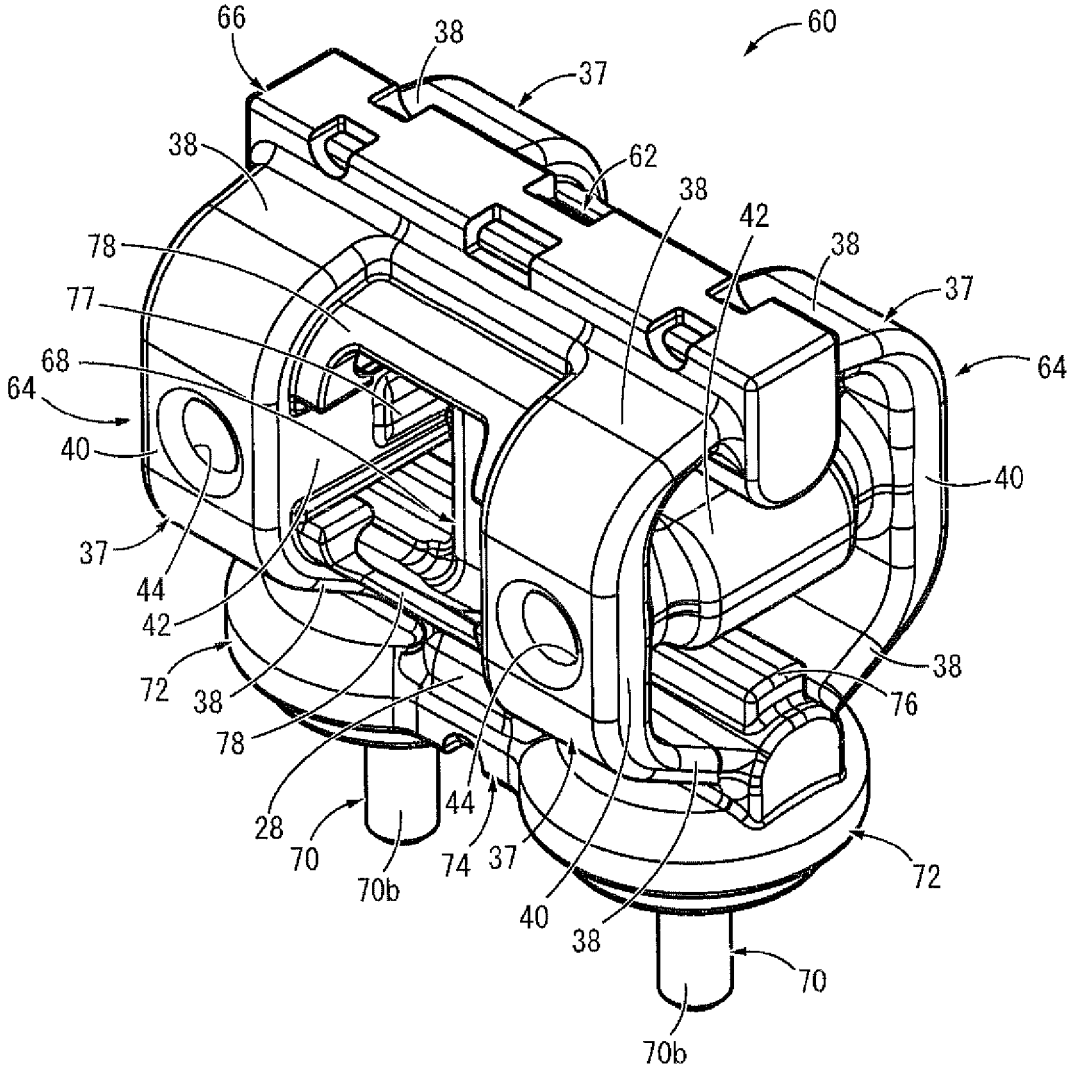
FIG. 9 is a perspective view showing a muffler hanger as a second embodiment of the present invention.
Figure 10:
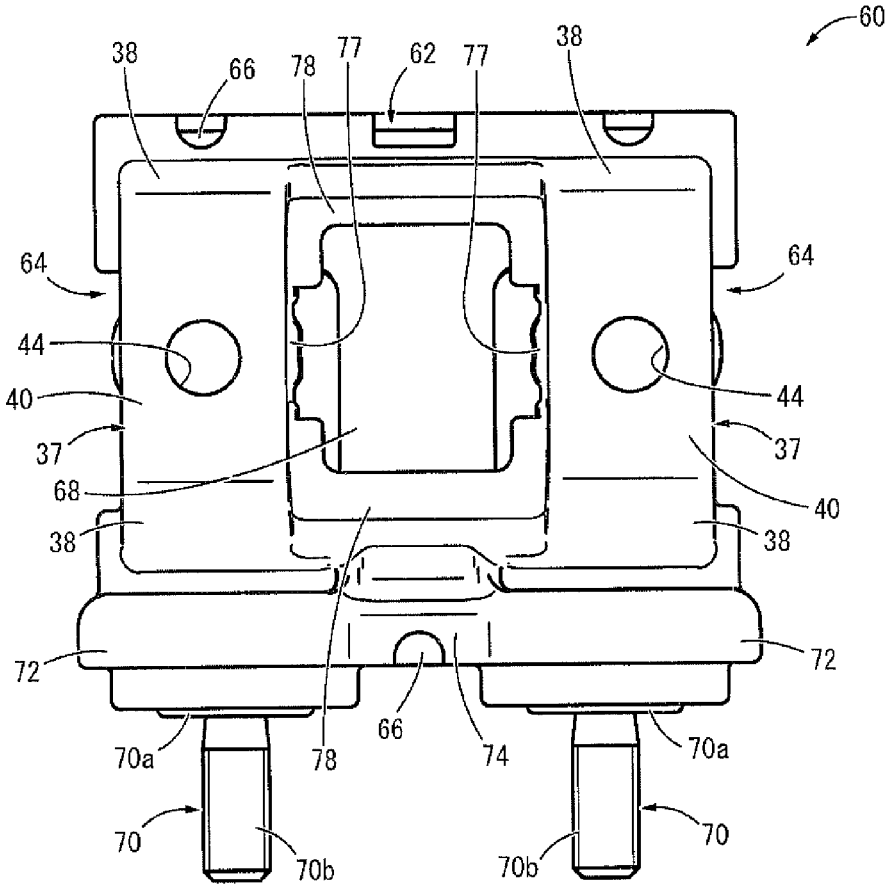
FIG. 10 is a front view of the muffler hanger shown in FIG. 9.
Figure 11:
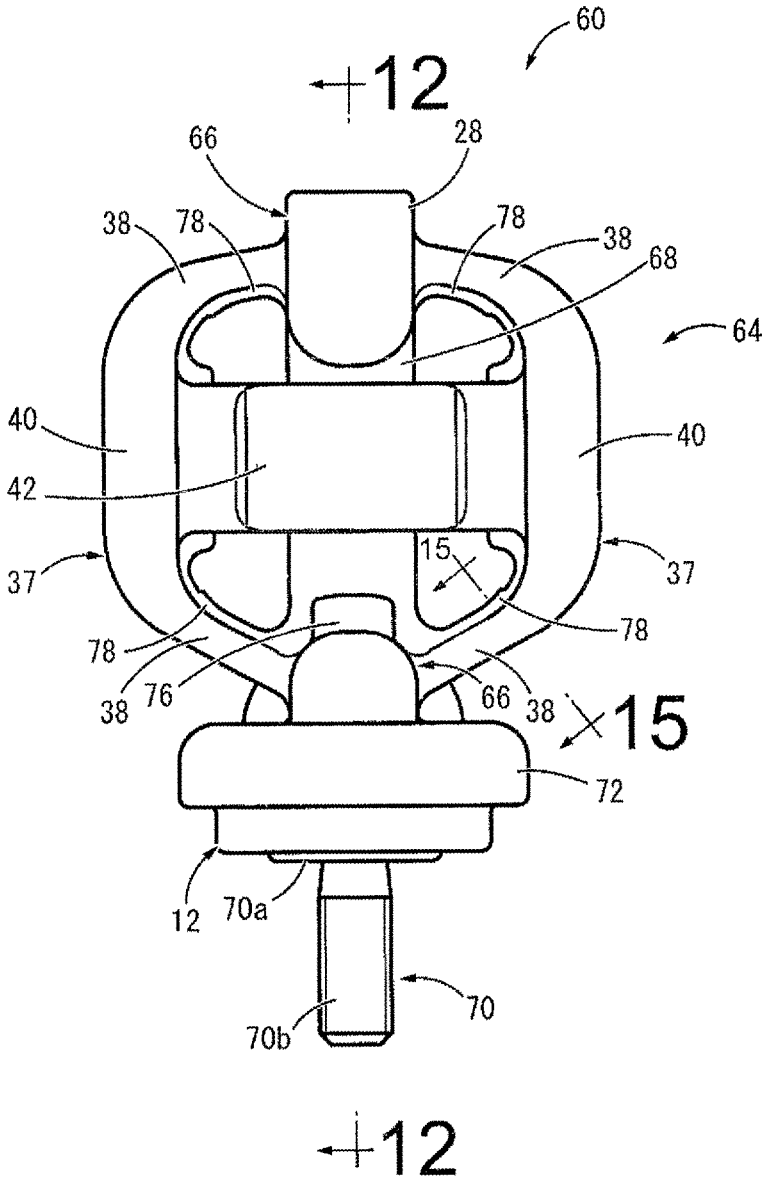
FIG. 11 is a left side view of the muffler hanger shown in FIG. 9.
Figure 12:
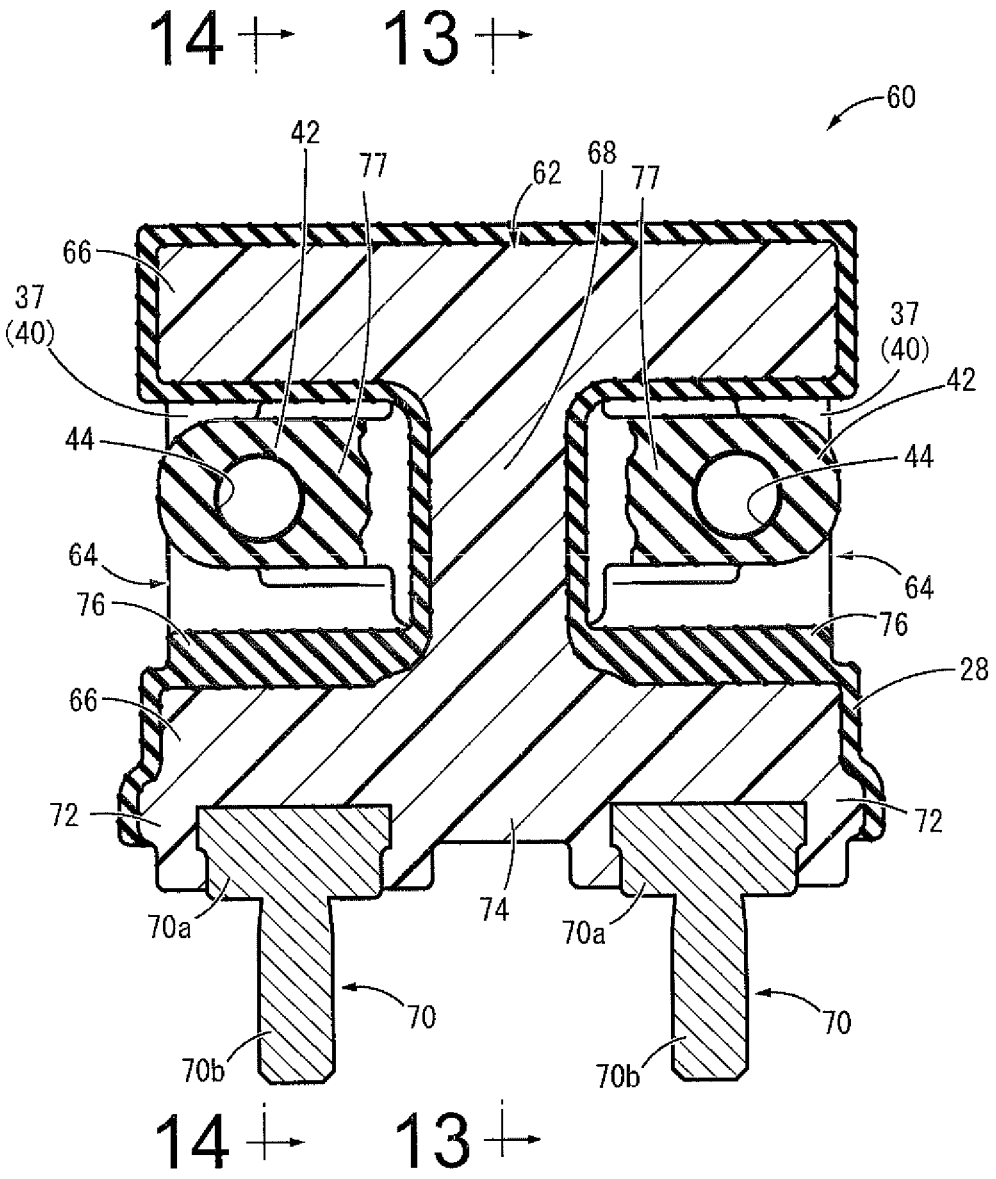
FIG. 12 is a cross section view taken along line 12-12 of FIG. 11.
Figure 13:
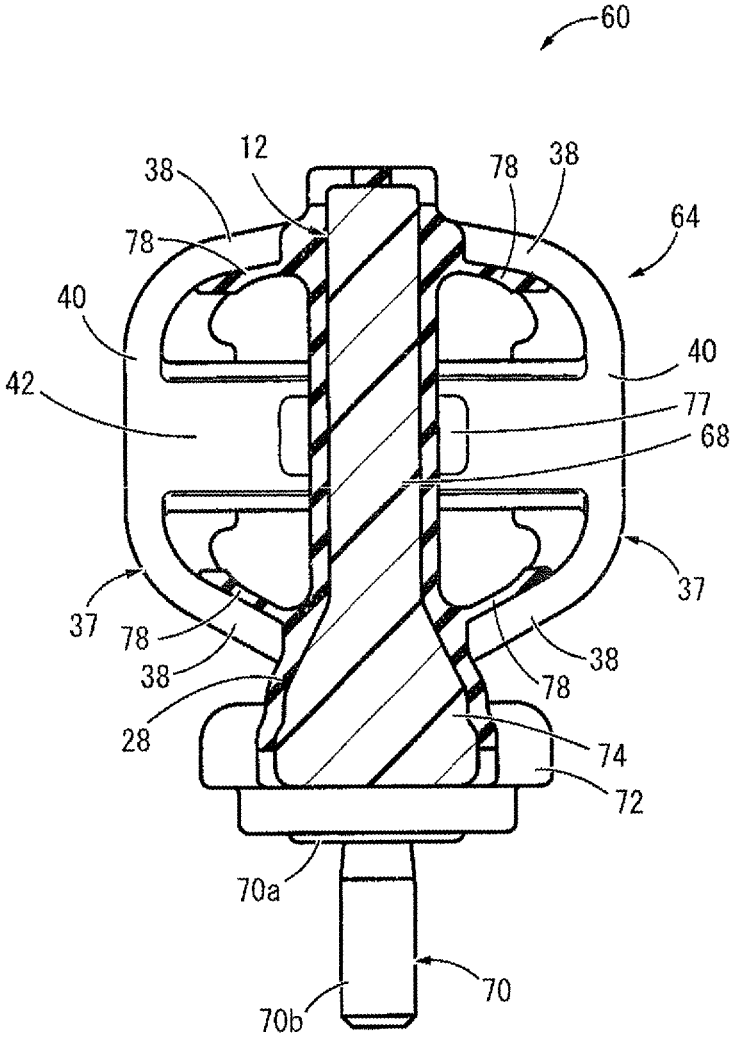
FIG. 13 is a cross section view taken along line 13-13 of FIG. 12.
Figure 14:
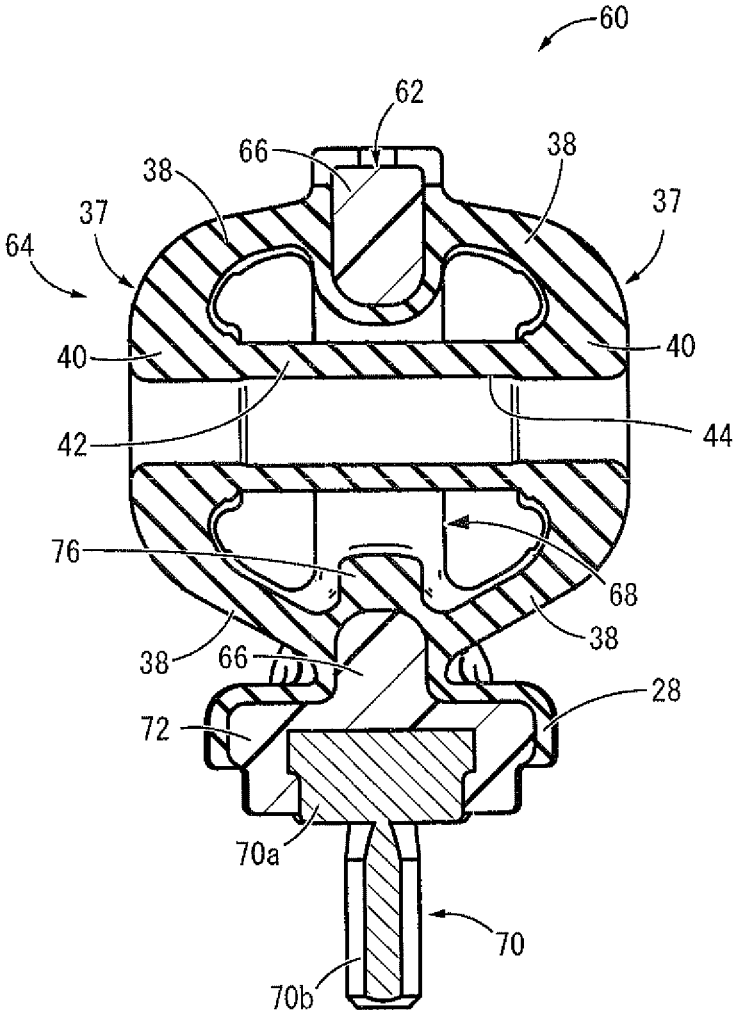
FIG. 14 is a cross section view taken along line 14-14 of FIG. 12.

It is possible to attach the muffler hanger 60 to the body material in a state where the muffler hanger 60 shown in FIG. 9 and the like is inverted vertically and suspended with the displacement suppress member 62 thereof overlapped with the bottom surface of the body material. In that case, considering the deformation applied to the mounting rubbers 64, 64 by the static support load of the muffler, it is possible to suitably implement shape confirmation and design deformation of mounting rubber 64, 64 including adjusting the position of the connecting part 42 between the upper and lower support parts 66, 66.

Also, with this kind of muffler hanger 60 of this embodiment, it is possible to effectively exhibit the same technical effects as those of the first embodiment, such as realizing good spring characteristics and vibration-prevention characteristics in each direction, realizing a stopper function in each direction and the like. Also, with the muffler hanger 60 of this embodiment, the same as with the muffler hanger 10 of the first embodiment, even when there is a break in the mounting rubbers 64, 64, at both sides sandwiching the junction part 68 of the displacement suppress member 62, the two muffler side mounting pins inserted in the muffler mounting holes 44 of the mounting rubber 64, 64 catch on the displacement suppress member 62. Thus, falling out of the muffler is prevented, and a fail-safe function is exhibited.

With this embodiment, regarding the connecting rubber 78 extending so as to join the inner circumference corner parts of the left and right arch shaped parts 37, 37 to each other, it is sufficient to be formed at least at one of the upper and lower fixing end part 38 side of each arch shaped part 37, 37. Also, it will suffice for the connecting rubber 78 as long as it prevents a corner from sticking out at the outer surface of each arch shaped part 37, 37, and with the condition of being able to demold the forming die, it is possible to also use a mode wherein the projecting height of the connecting rubber 78 is made smaller at the lengthwise middle part of the support part 66 so as to be substantially eliminated. Of course, this kind of connecting rubber 78 is not essential for the present invention.

What is claimed is:

1. A muffler hanger for suspending a muffler on a vehicle body, comprising:

a rigid displacement suppress member integrally provided with upper and lower support parts that extend in parallel while being separated vertically, and a junction part that joins the upper and lower support parts to each other at their lengthwise middle parts, the displacement suppress member being configured to attach to one of the vehicle body and the muffler; and mounting rubbers that connect the upper and lower support parts to each other at lengthwise both sides of the displacement suppress member, each of the mounting rubbers including a pair of arch shaped parts projecting in a direction of mutual separation, and each of the arch shaped parts having a mounting hole piercing therethrough, wherein the mounting rubbers provided to the lengthwise both sides of the displacement suppress member are configured to attach to another of the vehicle body and the muffler by inserting mounting parts each provided to the other of the vehicle body and the muffler into the corresponding mounting hole, and with the mounting parts inserted in the arch shaped parts of the respective mounting rubbers such that the mounting parts are arranged between the upper and lower support parts at both sides of the junction part, a displacement regulator that limits a relative displacement volume of the muffler in relation to the vehicle body is constituted by abutment of the mounting parts against the displacement suppress member.

2. The muffler hanger according to claim 1, wherein the junction part of the displacement suppress member includes an attachment part configured to attach to the vehicle body.

3. The muffler hanger according to claim 1, wherein one of the upper and lower support parts of the displacement suppress member includes an attachment part configured to attach to the vehicle body.

4. The muffler hanger according to claim 3, wherein the attachment part comprises a mounting bolt implanted in the one of the upper and lower support parts.

5. The muffler hanger according to claim 1, wherein the mounting rubbers are configured to attach to the muffler by each of the mounting parts of the muffler being inserted in the mounting hole of the corresponding mounting rubber, both lengthwise end parts of the upper support part of the displacement suppress member project upward above the middle part so as to constitute thick fixing parts that are thick vertically, top end parts of the pair of arch shaped parts that constitute each of the mounting rubbers are fixed to a top part of the corresponding thick fixing part, and bottom end parts of the pair of arch shaped parts that constitute each of the mounting rubbers are fixed to a top part of a corresponding lengthwise end part of the lower support part.

6. The muffler hanger according to claim 1, wherein the displacement suppress member is formed using synthetic resin.

7. The muffler hanger according to claim 1, wherein middle parts of the pair of arch shaped parts that constitute the mounting rubber are connected to each other by a tube-shaped connecting part, and the connecting part includes a center hole that constitutes the mounting hole.

8. The muffler hanger according to claim 1, wherein a thickness of the pair of arch shaped parts that constitute the mounting rubber is larger at a middle part than at both end parts fixed to the upper and lower support parts.

9. The muffler hanger according to claim 1, wherein the mounting rubbers provided at the lengthwise both sides of the displacement suppress member are integrally formed by being connected to each other via a coating rubber that covers a lengthwise middle part of the displacement suppress member.

10. The muffler hanger according to claim 1, wherein the mounting rubbers provided at the lengthwise both sides of the displacement suppress member are connected to each other by a connecting rubber extending in a lengthwise direction along the displacement suppress member at inner circumference corner parts on both upper and lower end parts of each of the arch shaped parts that are opposite in the lengthwise direction of the displacement suppress member.

* * * * *